US007935420B2

(12) United States Patent
Rogers

(10) Patent No.: US 7,935,420 B2
(45) Date of Patent: May 3, 2011

(54) SEAL WITH EXPANDABLE GRAPHITE

(75) Inventor: Norman Edward Rogers, Derbyshire (GB)

(73) Assignee: Refractory Intellectual Property GmbH & Co. KG, Wienerbergstrabe (AU)

( * ) Notice: Subject to any disclaimer, the term of this patent is extended or adjusted under 35 U.S.C. 154(b) by 372 days.

(21) Appl. No.: 11/918,776

(22) PCT Filed: Mar. 23, 2006

(86) PCT No.: PCT/GB2006/001047

§ 371 (c)(1),
(2), (4) Date: Nov. 16, 2007

(87) PCT Pub. No.: WO2006/111696

PCT Pub. Date: Oct. 26, 2006

(65) Prior Publication Data

US 2009/0008884 A1 Jan. 8, 2009

(30) Foreign Application Priority Data

Apr. 20, 2005 (GB) ..... 0507940.5

(51) Int. Cl.
*B32B 9/00* (2006.01)

(52) U.S. Cl. ..... 428/408; 428/921; 523/179

(58) Field of Classification Search ..... 277/650; 523/179; 428/408, 921
See application file for complete search history.

(56) References Cited

U.S. PATENT DOCUMENTS

| | | | | |
|---|---|---|---|---|
| 4,400,433 | A | 8/1983 | Ishiguro et al. | |
| 4,945,015 | A | 7/1990 | Milner et al. | |
| RE36,206 | E * | 5/1999 | Borneby | 277/627 |
| 6,153,668 | A | 11/2000 | Gestner et al. | |

FOREIGN PATENT DOCUMENTS

| | | |
|---|---|---|
| JP | 2001-286995 | 10/2001 |
| WO | WO 02/083344 A1 | 10/2002 |

OTHER PUBLICATIONS

Eikoh Patent Office; Notification of Reason for Rejection; Application No. 2008-507144, Dispatch Date Apr. 13, 2010.

* cited by examiner

*Primary Examiner* — Timothy M Speer
(74) *Attorney, Agent, or Firm* — Nixon & Vanderhye

(57) ABSTRACT

Seal, particularly for use with a ladle shroud in the casting of molten metal from a ladle, having an intumescent composition containing expandable graphite from which some, but not all, of interstitial water present therein has been removed. The interstitial water can be driven off from known expandable graphite by heating it to between approximately 230° C. and 280° C. for approximately 30 minutes. Once part of its interstitial water has been removed, the expandable graphite is used to produce the intumescent composition, which is then formed/shaped into the required seal.

9 Claims, No Drawings

SEAL WITH EXPANDABLE GRAPHITE

This application is the U.S. National Phase of International Application PCT/GB2006/001047, filed 23 Mar. 2006, which designated the U.S. PCT/GB2006/001047 claims priority to British Application No. 0507940.5 filed 20 Apr. 2005. The entire content of these applications are incorporated herein by reference.

This invention relates to a seal, particularly for use with a ladle shroud in the casting of molten metals from a ladle.

A problem has been found to exist during ladle changes when the seal used with the ladle shroud is based on expandable graphite. Typically interstitial water present in expandable graphite starts to produce sufficient vapour pressure to initiate graphitic expansion at approximately 200° C. If exposed to temperatures in excess of say 500° C. to 700° C. over a short period of time, the expansion becomes so rapid that much graphite can become detached and lost and as a consequence the seal may become mechanically disrupted if it is unconstrained by two surfaces.

During start-up of the casting process, the seal is sandwiched at the point of abutment between an inner surface of a flange of the ladle shroud and a surface of a ladle nozzle. In this situation, as the seal heats up and the graphite tries to expand, flakes of graphite cannot do so and consequently they entwine around each other as they intumesce, and form a very effective gas seal. During ladle changes, however, a very different situation exists. At a ladle change, a fresh seal is placed into a hot ladle shroud and, in the worst case, up to three or four minutes may elapse before the shroud is attached to the ladle and the seal is constrained between two surfaces.

During the period whilst the fresh seal is unconstrained, it is heated by hot gases rising through the hot (approximately 1200° to 1400° C.) ladle shroud, and as a result the seal starts to intumesce, and graphite material detaches and is lost by uncontrolled expansion of the seal. The longer the delay is attaching the shroud to the ladle, the poorer will be the performance of the seal due to the loss of the seal material which expands and breaks away as described. This deterioration of the seal results in more ingress at the abutment point and therefore more nitrogen pick-up.

An object of the invention is to provide a seal which can be used to obviate or reduce the above problem.

According to the invention there is provided a seal comprising an intumescent composition containing expandable graphite from which some, but not all, of interstitial water present therein has been removed.

Preferably the interstitial water has been removed by heating known expandable graphite to a temperature at which a required percentage of interstitial water is driven off. For many known types of expandable graphite, preferably approximately 40% to 60% of the interstitial water is removed. Desirably this is achieved by heating the expandable graphite to between approximately 230° C. to 280° C. for, in one embodiment, approximately 30 minutes.

Thus, in one embodiment of the present invention a selected type of known, untreated, expandable graphite is first heated to drive off a certain percentage of the interstitial water which it contains. To drive off between 40% to 60% of the interstitial water, the expandable graphite is thus firstly heated to, for example, between 230° C. to 280° C., and in one embodiment the graphite is maintained at this temperature for approximately 30 minutes.

Once the required amount of interstitial water has been driven off, the pre-formed expandable graphite is then used to produce the intumescent composition, which is then formed/shaped into the required seal, for example for a ladle shroud used in the casting of molten metals.

It has been found by experiments and trials that the preheating of the expandable graphite present in the intumescent composition results in the seal undergoing a more controlled expansion, in use, during ladle changeover, whilst still acting as a gas tight seal. Accordingly as a consequence ladle changeover times can be extended, if necessary, without a concomitant loss of quality in the metal cast, i.e. steel.

The invention claimed is:

1. A seal comprising an intumescent composition containing expandable graphite from which some, but not all, of interstitial water present therein has been removed.

2. A seal as claimed in claim 1, in which 40% to 60% by mass of the interstitial water is removed.

3. A seal as claimed in claim 1, wherein the interstitial water has been removed by heating known expandable graphite to a temperature at which a required percentage of interstitial water is driven off.

4. A seal as claimed in claim 3, wherein 40% to 60% by mass of the interstitial water is driven off.

5. A seal is claimed in claim 3, wherein the interstitial water is driven off by heating the expandable graphite to between 230° C. and 280° C.

6. A seal as claimed in claim 5, wherein the heating maintains the expandable graphite at between 230° C. and 280° C. for 30 minutes.

7. A seal as claimed in claim 1, in which after the required amount of interstitial water has been removed from said expandable graphite, said expandable graphite is used to form the intumescent composition.

8. A seal as claimed in claim 7, in which said intumescent composition is formed/shaped into the required seal.

9. A seal as claimed in claim 1, adapted for a ladle shroud used in the casting of molten metals.

* * * * *